US009538886B2

(12) United States Patent
Ros Marín

(10) Patent No.: US 9,538,886 B2
(45) Date of Patent: Jan. 10, 2017

(54) HAND-DRYER

(71) Applicant: FFUUSS 2013, S.L., Solsona (Lérida) (ES)

(72) Inventor: Óscar Ros Marín, Solsona (ES)

(73) Assignee: FFUUSS 2013, S.L., Solsona (LÉRIDA) (ES)

( * ) Notice: Subject to any disclaimer, the term of this patent is extended or adjusted under 35 U.S.C. 154(b) by 13 days.

(21) Appl. No.: 14/766,932

(22) PCT Filed: Feb. 12, 2014

(86) PCT No.: PCT/ES2014/070098

§ 371 (c)(1),
(2) Date: Aug. 10, 2015

(87) PCT Pub. No.: WO2014/125146

PCT Pub. Date: Aug. 21, 2014

(65) Prior Publication Data

US 2016/0007813 A1 Jan. 14, 2016

(30) Foreign Application Priority Data

Feb. 13, 2013 (ES) ..... 201330188
Feb. 22, 2013 (ES) ..... 201330216 U

(51) Int. Cl.
*F26B 25/06* (2006.01)
*A47K 10/48* (2006.01)
*F24H 3/04* (2006.01)

(52) U.S. Cl.
CPC ..... *A47K 10/48* (2013.01); *F24H 3/0405* (2013.01); *F24D 2220/20* (2013.01)

(58) Field of Classification Search
CPC ..... F26B 19/00; F26B 21/00; F26B 25/00; F26B 25/06; E03C 1/00; E03C 1/05
USPC ..... 34/90, 218, 233; 4/623, 626; 392/384, 392/385
See application file for complete search history.

(56) References Cited

U.S. PATENT DOCUMENTS 5,459,944 A * 10/1995 Tatsutani ..... A47K 10/48 34/202
6,038,786 A * 3/2000 Aisenberg ..... A47K 10/48 34/202
6,050,000 A * 4/2000 Curzon ..... A47K 10/48 34/202
7,437,833 B2 * 10/2008 Sato ..... A47K 10/48 34/90

(Continued)

FOREIGN PATENT DOCUMENTS

CA 2904318 A1 * 9/2014 ..... A47K 10/485
DE EP 0884062 A1 * 12/1998 ..... A61M 16/1075

(Continued)

*Primary Examiner* — Stephen M Gravini
(74) *Attorney, Agent, or Firm* — Snell & Wilmer LLP

(57) ABSTRACT

Hand dryer 1 wherein the control means 9 are configured for operate at least in two operating regimes, a normal operating regime wherein the motor 5 pumps the air for drying the hands and which is activated by the sensor detection 8 and a motor heating operating regime 5 wherein the stator 7 and/or the rotor 6 of the motor 5 are fed for increasing its temperature and maintain it to a predetermined temperature for accumulating heat which is activated by no detection of the sensor 8, such that at the start of the normal operating regime, the motor 5 has stored heat for ensuring that the air exits already heated.

20 Claims, 13 Drawing Sheets

(56) References Cited

U.S. PATENT DOCUMENTS

| | | | | |
|---|---|---|---|---|
| 7,596,883 | B2 * | 10/2009 | Kameishi | A47K 10/48 250/432 R |
| 7,614,160 | B2 * | 11/2009 | Kameishi | A47K 10/48 34/90 |
| 7,657,162 | B2 * | 2/2010 | Itoigawa | A47K 10/48 392/380 |
| 7,946,055 | B2 * | 5/2011 | Churchill | A47K 10/48 134/26 |
| 7,971,368 | B2 * | 7/2011 | Fukaya | A47K 10/48 222/1 |
| 8,341,853 | B2 * | 1/2013 | French | A47K 10/48 15/300.1 |
| 8,347,521 | B2 * | 1/2013 | Churchill | A47K 10/48 134/26 |
| 8,347,522 | B2 * | 1/2013 | Dyson | A47K 10/48 34/104 |
| 8,490,291 | B2 * | 7/2013 | Churchill | A47K 10/48 222/1 |
| 8,850,713 | B2 * | 10/2014 | Nakamura | A47K 10/48 132/73 |
| 9,060,657 | B2 * | 6/2015 | Ryan | A47K 10/48 |
| 9,125,533 | B2 * | 9/2015 | Babikian | A47K 10/485 |
| 9,282,856 | B2 * | 3/2016 | Fukano | A47K 10/48 |
| 2007/0079524 | A1 | 4/2007 | Sato et al. | |
| 2008/0273866 | A1 * | 11/2008 | Itoigawa | A47K 10/48 392/384 |
| 2016/0007813 | A1 * | 1/2016 | Ros Mar n | A47K 10/48 34/569 |

FOREIGN PATENT DOCUMENTS

| | | | | |
|---|---|---|---|---|
| EP | 2399497 | | 12/2011 | |
| JP | H 11113794 | | 4/1999 | |
| JP | 2003180554 | | 7/2003 | |
| JP | 2003250720 | | 9/2003 | |
| JP | 2010220918 | A * | 10/2010 | |
| JP | 2012023294 | A * | 2/2012 | |
| JP | WO 2012023294 | A1 * | 2/2012 | A47K 10/45 |
| JP | 2014188091 | A * | 10/2014 | |
| WO | WO 9953250 | A1 * | 10/1999 | A47K 10/48 |
| WO | WO 2006/042896 | | 4/2006 | |

* cited by examiner

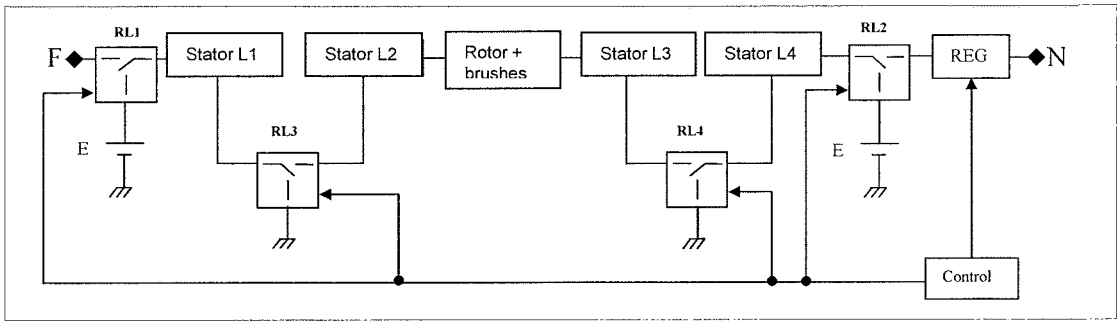
Fig. 4
Fig. 5
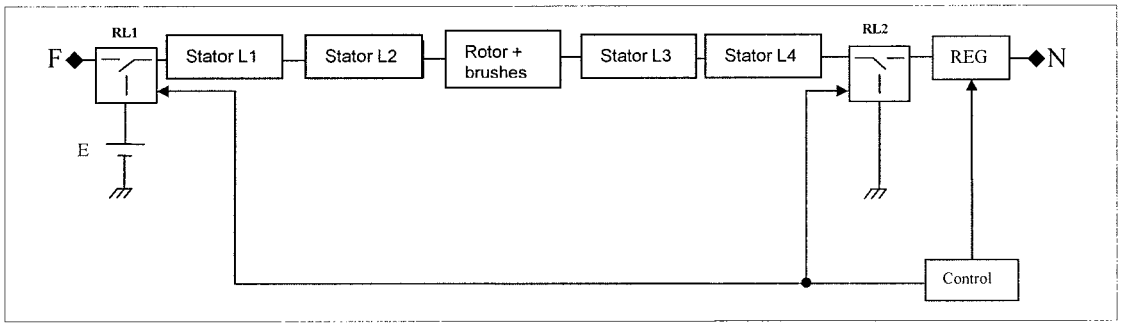

HAND-DRYER

The present invention relates to a hand dryer which provides for a high comfort when drying, without the need of specific heating resistors, a hand dryer which minimizes the projection of drops to the ground and a hand dryer provided with silencing means.

BACKGROUND OF THE INVENTION

Known are in the art hand dryers comprising:

A housing;

A volume for receiving the hands;

A circuit for pumping air;

A drive motor which drives a fan arranged in the air circuit provided with a rotor and a stator;

A hands presence sensor in the volume and;

Operation control means;

It is known to apply in many hand dryers with these components, heating resistors for heating the air. These are resistors that are placed at the exit of the air flow of the motor and that raise the temperature of the air in order to decrease the drying time and increase the comfort when drying in case the atmosphere of the room where the dryer is located is very cold.

The cold atmosphere, coupled with the increased evaporation of water in the hands due to the high air flow causes a considerable feeling of cold in the hands.

There are many applications including these heating elements. See for example the U.S. Pat. No. 266,229 for a "Hand Dryer apparatus" or the U.S. Pat. No. 254,101 for a "Multi-function dryer".

The patent US20100296799 A1 "Air flow directing structure for hand dryer", proposes an assembly consisting of a motor and a resistor, this latter placed within the circular flow of air out of the motor, which passes through the resistor and hence is directed to the element to be dried. This patent claims its compactness and low cost. However, it entails significant drawbacks:

At the cycle initiation, the air exits cold since the resistors are not yet hot;

There is a high energy consumption since the resistor consumption has to be added to that of the motor, which is very important in the case of domestic or public facilities (airport toilets, convention halls . . . ) where a large number of hand dryers is present that can be operated simultaneously;

Risk of fire due to the high temperature rise of the heating resistors or due to a motor malfunction, which may cause the lack of airflow for cooling them;

Combined with the previous point, another serious problem is that a high air flow causes dust deposits on the heating resistors since they capture the dust thus preventing the correct dissipation of heat and thus raising its temperature, the resistor becoming wrapped with "dust", which is an excellent fuel.

The price: the resistor is one more piece, to which the necessary assurances as thermostats, thermal fuses, insulation surrounding them, materials with self-extinguishing characteristics etc must be added.

Also known are hand dryers of the type comprising a cavity for receiving the hands, the cavity being opened upwardly and laterally, such that a top opening, a first lateral opening and a second lateral opening are defined, the cavity for receiving the hands being bounded by a first surface and a second surface provided with air injection holes for drying the hands.

A hand dryer of this type is shown in FIG. 11.

A major drawback of this type of hand dryers is that part of the water removed from the hands by the air jets that emerge from the air injection orifices are projected as droplets G by said side openings, as illustrated in FIG. 17 by the two pairs of arrows, these drops finally ending on the floor.

If these devices are used continuously, for example in public services places, projected drops cause the soil to become dirty and unpleasant. This is another issue addressed by this application.

A major drawback of this type of hand dryers is that they are very noisy.

One proposed solution is to provide a labyrinth in the air inlet of the hand dryer, that is, upstream of the motor. Examples of such solutions are described in the documents WO2012017570, JP2010279436 and JP2003180554.

Now, the inventors have found that even so, the decibel level remains high.

Also known in the art are hand dryers provided with sterilization/purification means arranged in the air circulation circuit, for example from WO2012139117, JP3028621, KR20080029143 and US2008052952.

Also are known hand dryers provided with information screens, as described for example in US2006171660 or KR200452289.

DESCRIPTION OF THE INVENTION

To overcome the shortcomings of the prior art, the present invention proposes a hand dryer comprising:

A housing;

A volume for receiving the hands;

A circuit for pumping air;

A drive motor which drives a fan arranged in the circuit provided with a rotor and a stator;

A hands presence sensor in the volume;

Operation control means;

which is characterised in that the control means are configured for operate at least in two operating regimes:

A normal operating regime wherein the motor pumps the air for drying the hands and which is activated by the sensor detection;

A motor heating operating regime wherein the stator and/or the rotor of the motor are fed for increasing its temperature and maintain it to a predetermined temperature for accumulating heat which is activated by no detection of the sensor.

In this manner, at the start of the normal operating regime, the motor has stored heat for ensuring that the air exits already heated, such that it is possible to dispense with additional heating circuits, such as a resistor.

Preferably, the hand dryer does not comprise a separate heating circuit apart from the motor circuits.

To achieve preheating, the excitation of the motor windings can be carried out with direct current or alternating current.

Different variants for motor control, for both types of excitation, are detailed in the description of preferred embodiments.

Furthermore, to overcome the drawback associated with the lateral escape of water drops, the present invention proposes a hand dryer of the type comprising a cavity opened upwardly and laterally for receiving the hands, such that a top opening, a first lateral opening and a second lateral opening are defined, the cavity for receiving the hands being bounded by a first surface and a second surface provided with air injection holes for drying the hands, which is characterised in that the air injection holes closest to the lateral openings of the first surface or of the second surface are arranged closer to the lateral openings than the air injection holes closest to the lateral openings of the second surface or of the first surface respectively, such that said hole or said holes arranged closer to the lateral openings of the first and/or of the second surface do not have air injection holes arranged in front of them, thus allowing the air injected by said holes arranged closer to the lateral openings to form air curtains which minimize or prevent the projection of drops of water towards the outside by said lateral openings.

Preferably, the air injection holes closest to the lateral openings that do not have injection holes in front of are arranged in the same surface, that is, in the first surface or in the second surface.

Advantageously, the air injection holes closest to the lateral openings that do not have injection holes in front them of are arranged in vertical rows.

More preferably, the air injection holes closest to the lateral openings that do not have injection holes in front of them have an oblong section with the longest axis oriented in the vertical direction.

According to another aspect of the invention, to reduce noise emissions from these devices, the present invention proposes a hand dryer of the type comprising a cavity for receiving the hands opened upwardly and laterally, such that a top opening, a first lateral opening and a second lateral opening are defined, the cavity for receiving the hands being bounded by a first surface and a second surface provided with air injection holes for drying the hands, which is characterised in that the injection holes are distributed in at least three groups:

- a first group of holes which air passage sections are inside a first range of air passage sections;
- a second group of holes which air passage sections are inside a second range of air passage sections;
- a third group of holes which air passage sections are inside a third range of air passage sections, the three ranges being different.

The inventors have noted that the provision of holes of different sections contributes strongly to reduce the level of noise emitted by the hand dryer.

Preferably:

The first range goes from 8 to 9 $mm^2$;

The second range goes from 9 to 11 $mm^2$;

The third range goes from 11 to 12 $mm^2$.

And still more preferably:

The holes of the first group have a section of 8.5 $mm^2$;

The holes of the second group have a section of 10 $mm^2$;

The holes of the third group have a section of 11.5 $mm^2$.

The first surface may be defined as the closest to the user and the second surface as the closest surface to the mounting surface of the hand dryer.

Advantageously:

The first surface has between 12 and 16 holes of the first group, between 14 and 18 holes of the second group and between 16 and 20 holes of the third group;

The second surface has between 14 and 18 holes of the first group, between 14 and 18 holes of the second group and between 14 and 18 holes of the third group.

More advantageously:

The first surface has between 14 holes of the first group, 16 holes of the second group and 18 holes of the third group;

The second surface has between 16 holes of the first group, between 16 holes of the second group and between 16 holes of the third group.

Still more preferably, the holes of the first, second and third group are oblong and are arranged with the longest axis oriented along a substantially horizontal direction.

Advantageously, the holes are hexagonal and/or oblong.

According to a specially preferred embodiment, the hand dryer comprises a fourth group of holes, said holes being arranged at the sides of the first surface or of the second surface, such that they form air curtains.

Advantageously, the holes of the fourth group have a section which is in the range between 9 and 10 $mm^2$, and still more advantageously, have a section of 10.5 $mm^2$. These holes may be oblong and be vertically arranged.

Preferably, the holes of the first, second and third group each have an associated channel which extends as a protrusion in an air distribution chamber arranged behind each one of the first and second surfaces. These protrusions are channels tilted with respect to the first and second surfaces.

According to a specially preferred feature of the invention, which could be considered as an independent invention, the hand dryer comprises a driving motor-fan group M and air silencing elements arranged upstream of said driving motor-fan group M, said air silencing elements comprising, in the sense of the air circulation, the following components:

An air inlet grille;

An air passage surrounded by a crown of foam;

A foam block interposed in the air path;

An air inlet grille to the motor;

The internal air circulation circuit comprises a ion generation unit, preferably an ozone generation unit, to provide the air with sterilizing characteristics.

According to another particularly advantageous feature, that could also be considered as an invention by itself, the hand dryer comprises a visualization screen in the upper part of the second surface.

As usual in this type of hand dryers, the receiving cavity of the hands can comprise a water drain hole in the bottom.

Finally, the first surface is tilted 15° and the second surface tilted between 8° and 10° with respect to the vertical direction, inclinations that make specially comfortable the introduction of the hands in the drying volume of the hand dryer.

BRIEF DESCRIPTION OF THE FIGURES

For a better understanding of all that has been outlined, some drawings are attached, in which, schematically and solely by way of non-limiting example, practical cases of embodiment are shown.

FIGS. 2 to 5 are four block diagrams of four variants of the control elements for the preheating with direct current used in preferred embodiments of the hand dryer of the invention.

DESCRIPTION OF PREFERRED EMBODIMENTS

Figure 1:
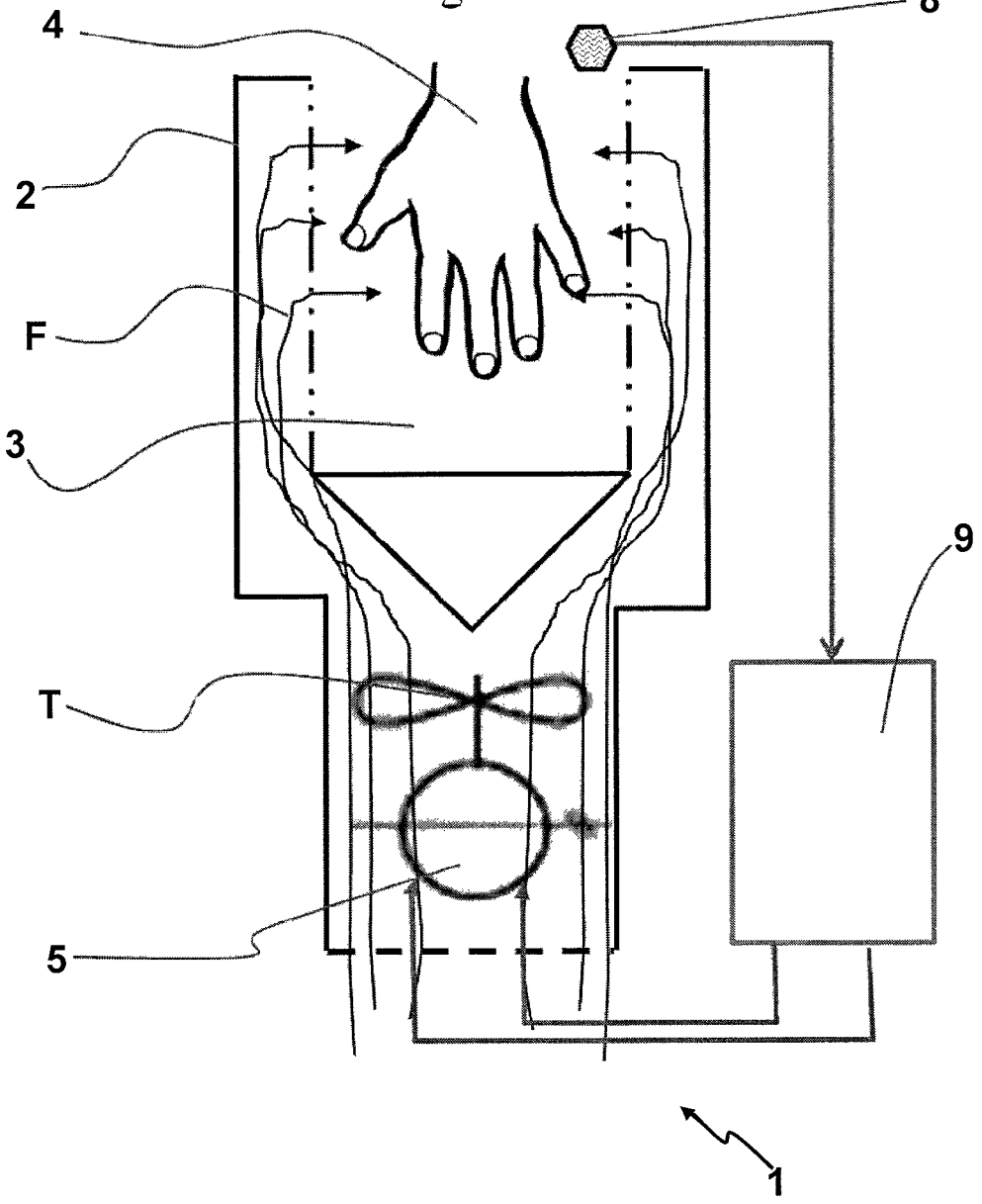
FIG. 1 is a scheme of a hand dryer according to the invention.

As it can be seen in FIG. 1 the invention relates to a hand dryer 1 comprising a housing 2, a volume 3 for receiving the hands 4, a circuit for pumping air, a drive motor 5 which drives a fan T arranged in the circuit provided with a rotor 6 and a stator 7, a hands presence sensor 8 in the volume 3 and operation control means 9.

Specifically, as it can be seen in the figures, the control means 9 are configured for operate at least in two operating regimes:

- A normal operating regime wherein the motor 5 pumps the air for drying the hands and which is activated by the sensor detection 8;
- A motor heating operating regime 5 wherein the stator 7 and/or the rotor 6 of the motor 5 are fed for increasing its temperature and maintain it to a predetermined temperature for accumulating heat which is activated by no detection of the sensor 8;

such that at the start of the normal operating regime, the motor 5 has stored heat for ensuring that the air exits already heated.

Below, the different options of motor control to achieve the purposes of the invention will be described. All these variants include a voltage regulating unit REG arranged in series between the fourth portion of stator and the neutral point.

It is to be understood that the operation control means 9 include both the motor control, i.e. it includes the REG unit, and the motor and ambient temperature sensors such as thermocouples, ptc, or the like.

I. Embodiments of Hand Dryers Provided with an Alternating Current Universal Motor In these embodiments the motor is an alternating current motor, wherein the stator can be divided in many sub-stators or winding portions, L1, L2, L3 and L4.

As will be seen below, the preheat function can be done with direct current or alternating current. We will also see that we can preheat either the stator+rotor assembly or the stator only.

A— Preheating with Excitation with Direct Current

A.1 Preheating of the Stator Only

As it can be seen in FIGS. 2 to 5, the preheating of the motor 5 can be done by feeding the windings with direct current, and comprises, arranged in series:

- A first portion of stator winding L1;
- A second portion of stator winding L2;
- The rotor-brushes assembly;
- A third portion of stator winding L3;
- A fourth portion of stator winding L4.

Figure 2:
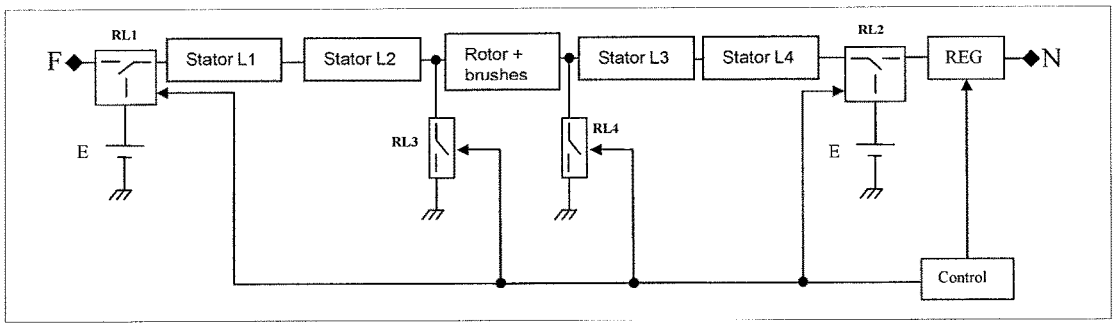

According to a first variant, illustrated in FIG. 2, the hand dryer comprises:

- A first relay RL1 between the supply voltage F and the first portion of stator winding L1;
- A second relay RL2 between the neutral point N and the fourth portion of stator winding L4;
- A third relay RL3 for the grounding of the connecting point between the second portion of stator winding L2 and the rotor-brushes assembly;
- A fourth relay RL4 for the grounding of the connecting point between the third portion of stator winding L3 and the rotor-brushes assembly;

the relays RL1, RL2, RL3, RL4 being connected to the operation control means 9.

In this case, the control of the relays RL1 and RL2 allows choosing the supply type, AC or DC, that has to be sent to the motor. When working with DC, for starting the heating function, the relays RL3 and RL4 must be commuted to ground for preventing the current to pass through the rotor.

The power supplies E may be the same, then they would work in parallel, or may be different, in which case they would work in series.

On the other hand, each lateral part can be preheated at once or may be preheated independently.

Figure 3:
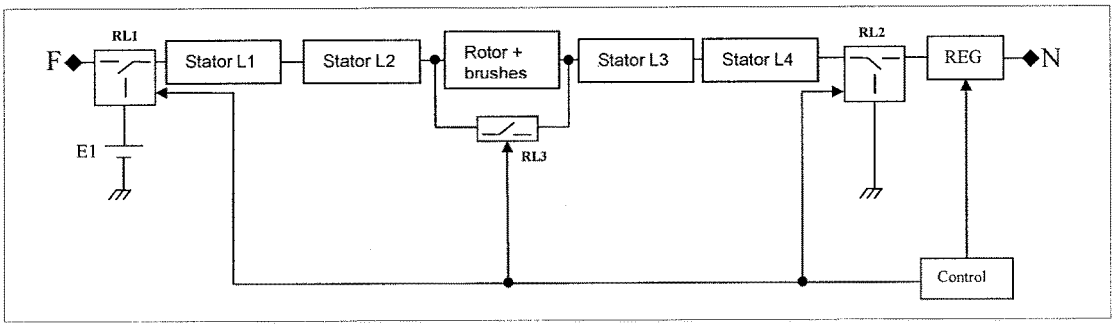

According to a second variant based in preheating with direct current, illustrated in FIG. 3, the hand dryer comprises:

- A first relay RL1 between the supply voltage F and the first portion of stator winding L1;
- A second relay RL2 between the neutral point N and the fourth portion of stator winding L4;
- A third relay RL3 for short-circuiting the terminals of the rotor-brushes assembly;

the relays RL1, RL2, RL3 being connected to the operation control means 9.

In this case, the control of the relays RL1 and RL2 allows choosing the type of supply, AC or DC, to be applied to the motor. When working in DC, for starting the preheating function, the relay RL3 commutes the rotor, for preventing the current from passing therethrough. With this scheme we can only work in series and the current going from right to left depending on how the power supply and the ground are arranged.

According to a third variant based in preheating with a direct current excitation, illustrated in FIG. 4, the hand dryer comprises:

- A first relay RL1 between the supply voltage F and the first portion of stator winding L1;
- A second relay RL2 between the neutral point N and the fourth portion of stator winding L4;
- A third relay RL3 between the first portion of stator winding L1 and the second portion of stator winding L2;
- A fourth relay RL4 between the third portion of stator winding L3 and the fourth portion of stator winding L4;
- The third relay RL3 being arranged for connecting the terminal of the first winding or either with the second portion of stator winding L2 or either with the neutral point N;
- The fourth relay RL4 being arranged for connecting the terminal of the fourth portion of stator winding or either with the third portion of stator winding L3 or either with the supply voltage;

the relays RL1, RL2 being connected to the operation control means 9.

In this case, the control of the relays RL1 and RL2 allows choosing the type of supply (AC or DC) to be applied to the motor. When working in DC, the preheating is started. Here the relays RL3 and RL4 physically isolate the rotor from the stator when this function is started. The power supplies E could be the same, such that they would operate in parallel. Or they could be different and then would work in series. On the other hand, either each lateral part can be preheated at once, or they can be independently preheated.

A.2 Preheating of the Rotor and the Stator

According to a fourth variant based in preheating with excitation with direct current, illustrated in FIG. 5, the hand dryer comprises:

A first relay RL1 between the supply voltage F and the first portion of stator winding L1, A second relay RL2 between the neutral point N and the fourth portion of stator winding L4;

In this case, the control of the relays RL1 and RL2 allows choosing the type of supply (AC or DC) to be applied to the motor. When working in DC, the preheating function starts. The current can flow from right to left or left to right, depending on the placement of the power supply E and the ground.

B. Preheating with Alternating Current

B.1 Preheating of the Stator Portions Only, Isolating the Rotor

Figure 6:
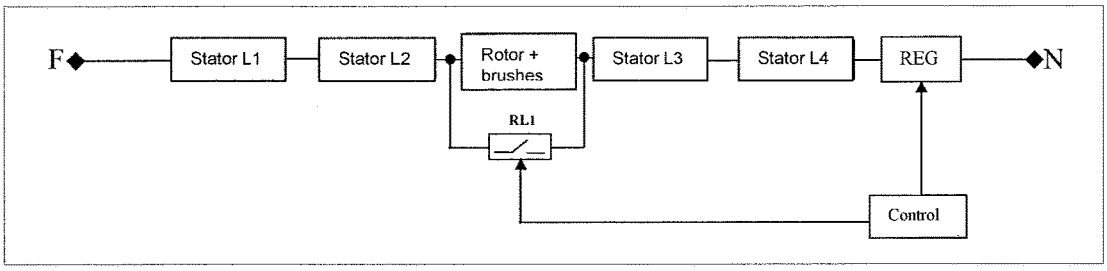
FIGS. 6 to 10 are four block diagrams of variants of the control elements for preheating with alternating current the hand dryer of the invention.

As it can be seen in FIGS. 6 to 9, the preheating can be carried out with alternating current, in which case the motor comprises, arranged in series:

A first portion of stator winding L1;

A second portion of stator winding L2;

The rotor-brushes assembly;

A third portion of stator winding L3;

A fourth portion of stator winding L4;

As it can be seen, according to a first variant based in an alternating current motor illustrated in FIG. 6, the hand dryer comprises a relay RL1 for short-circuiting the terminals of the rotor-brushes assembly connected to the operation control means 9.

In this case, with the voltage regulator REG, the minimum voltage necessary for the preheating is set when the relay RL1 is activated, thus bypassing the rotor.

Figure 7:
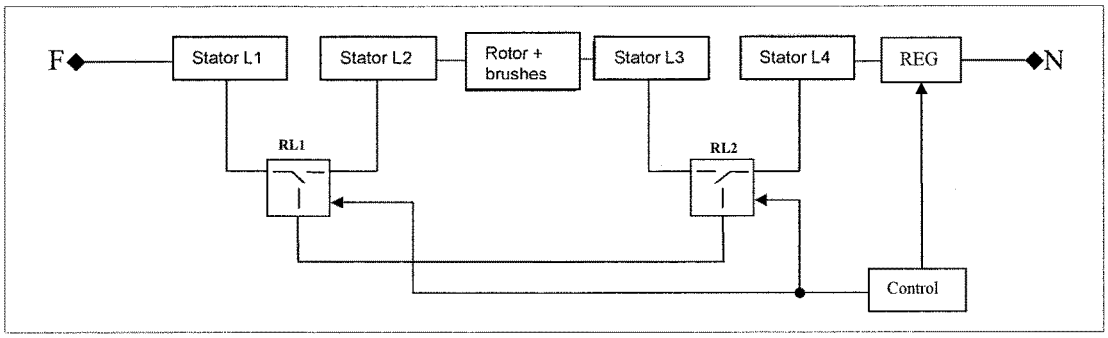

As it can be seen in FIG. 7, according to a second variant based in preheating with alternating current, the hand dryer comprises:

A first relay RL1 between the first portion of stator winding L1 and the second portion of stator winding L2;

A second relay RL2 between the third portion of stator winding L3 and the fourth portion of stator winding L4;

The relays being connected between them such that the first and fourth portions can be connected between them;

the relays RL1, RL2 being connected to the operation control means 9.

In this case, with the alternating voltage regulator REG the minimum voltage required is set for preheating, but in this case, the relays RL1 and RL2 act for physically isolating the rotor when the preheating function is activated.

Figure 10:
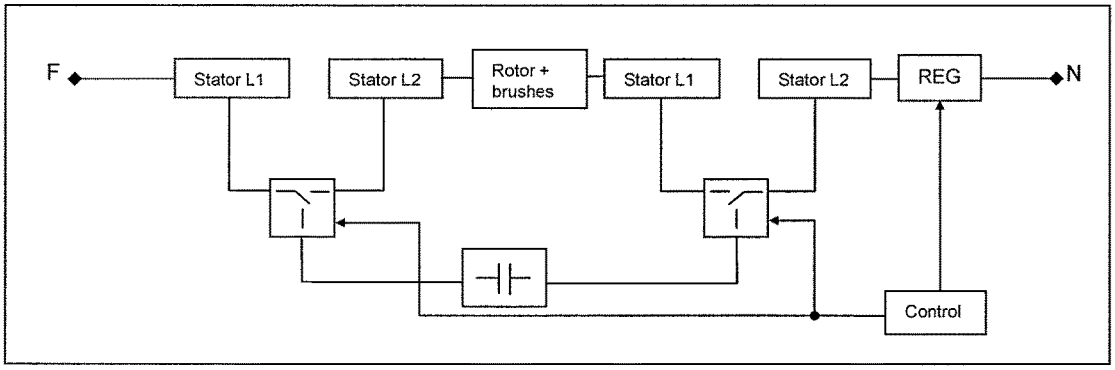

FIG. 10 shows a variant comprising the same elements than in the embodiment illustrated in FIG. 7, but wherein the relays are connected with an interposed capacitive load.

Figure 8:
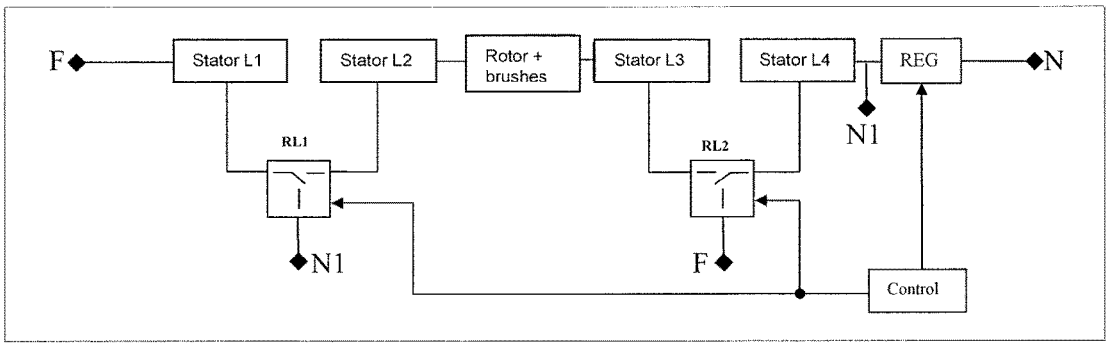
Figure 9:
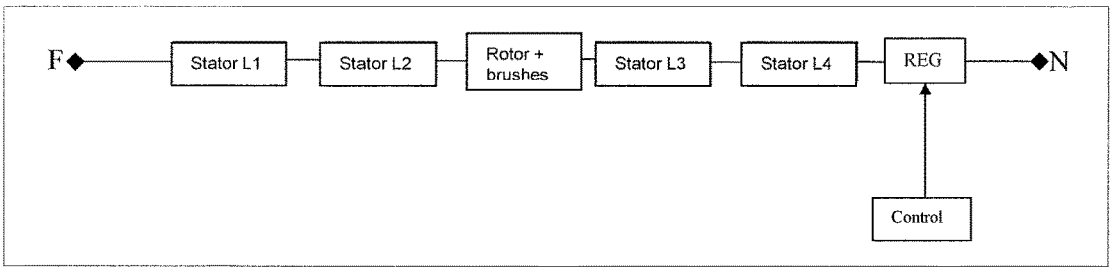

As it can be seen in FIG. 8, according to a third variant based in preheating with alternating current, the hand dryer comprises:

A first relay RL1 between the first portion of stator winding L1 and the second portion of stator winding L2;

A second relay RL2 between the third portion of stator winding L3 and the fourth portion of stator winding L4;

The first relay being RL1 arranged for connecting the terminal of the first relay or either with the second portion of stator winding L2 or either with the neutral point N;

The second relay being RL2 arranged for connecting the terminal of the fourth relay or either with the third portion of stator winding L3 or either with the supply voltage;

the relays RL1, RL2 being connected to the operation control means 9.

In this variant, with the alternating voltage regulator REG the minimum voltage required is set for preheating, but in this case, the relays RL1 and RL2 act for physically isolating the rotor when the preheating function is activated. In this case the preheating function can be independent on each side, by operating RL1 or RL2, or it can be done independently, operating RL1 and RL2 in parallel.

B.1 Preheating of the Stator Portions Only, Isolating the Rotor

Finally, as it can be seen, according to a third variant based in preheating with alternating current illustrated in FIG. 8, the hand dryer comprises a voltage regulating unit (REG) arranged in series between the fourth portion of stator and the neutral point, such that with the alternating voltage regulator REG the minimum voltage required is set for carrying out the preheating.

II. Variants of Hand Dryer Provided with Brushless Motor

In This case, the preheating is achieved by maintaining multiple stators active for some time without creating a rotation frequency. Activating only some stators can make the stator act as a resistor.

Therefore, the general principle of the invention consists in automatically preheating the motor while the hand dryer is connected to the power.

Taking advantage of the great mass of the motor (rotor and stator) and that the air is passing therethrough, the invention is based in preheating the motor so that when used in the first drying cycle it is already hot and provides warm air from the start.

When the motor has already conducted several cycles of drying thanks to the normal operation, the motor has already warmed and the temperature of the air that reaches the hands is the right one.

The problem is in the first cycle. The motor is cold and the air exits at the room temperature, affected by the high air flow which causes a sensation of cold due to the evaporation of the water in the hands, making it very unpleasant and with a poor drying performance.

Figure 11:
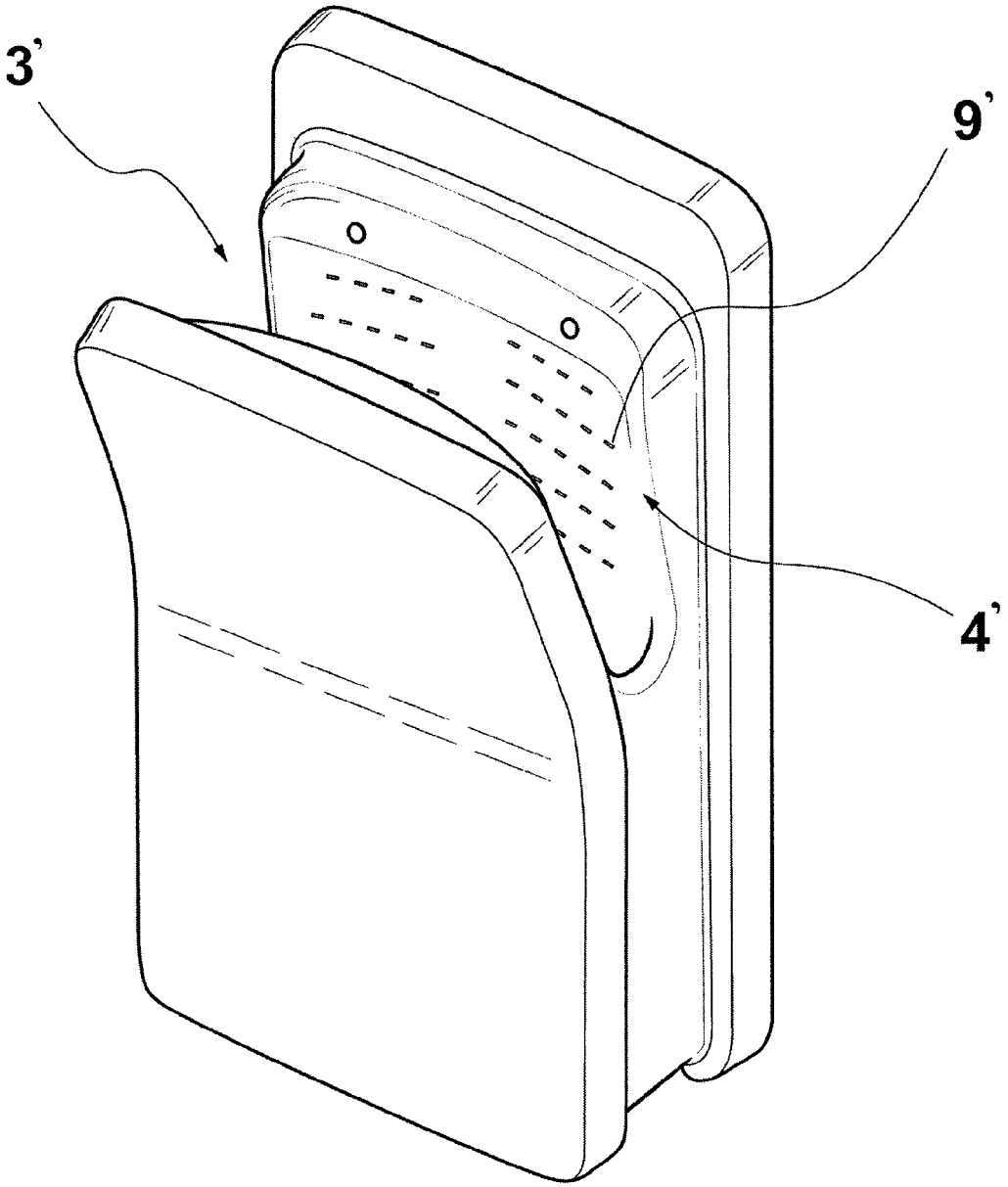
FIG. 11 is a perspective view of a hand dryer according to the invention.
Figure 12:
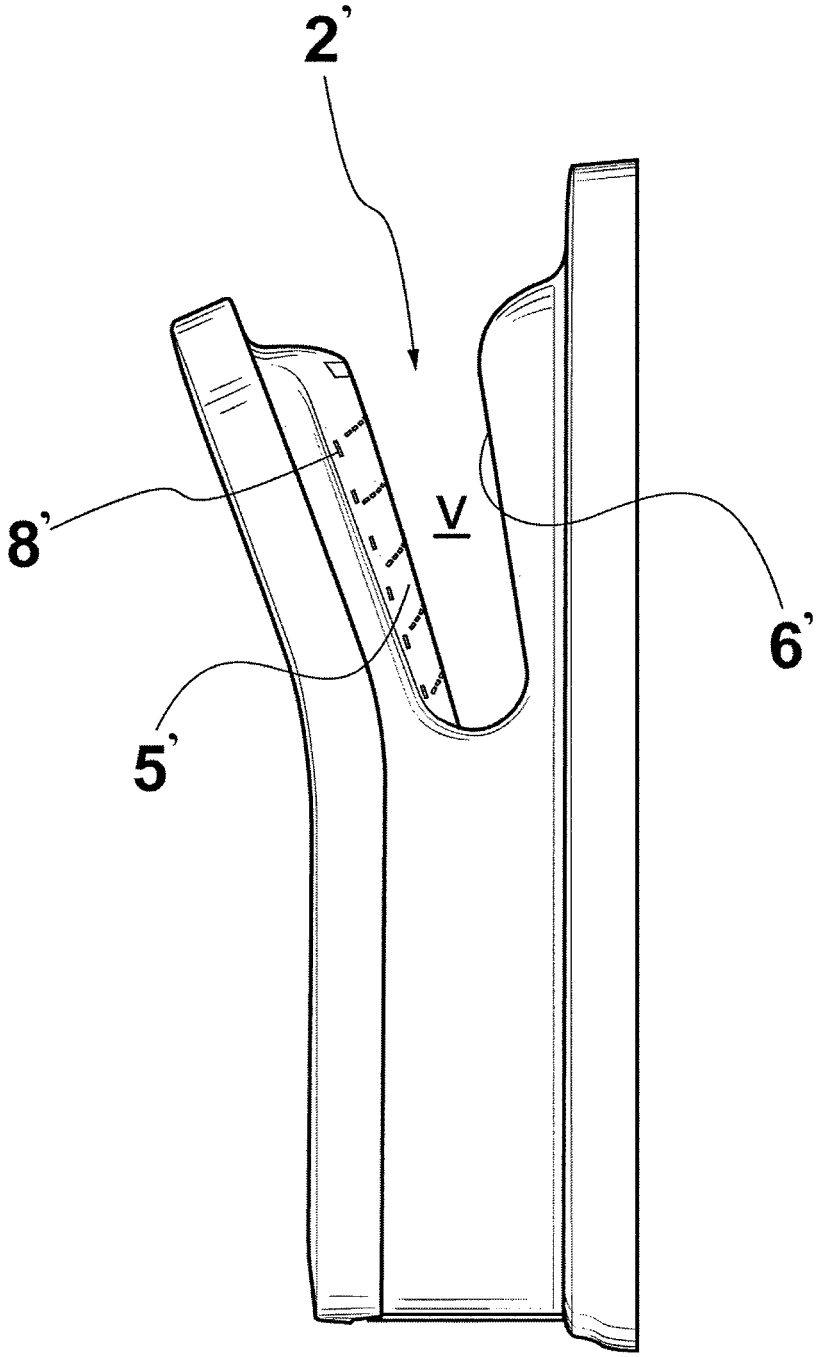
FIG. 12 is a side elevation view of the hand dryer.

On the other hand, as it can be seen in FIGS. 11 and 12, the invention also generally relates to a hand dryer 1' of the type comprising a reception cavity V for the hands opened upwardly and laterally, such that a top opening 2', a first lateral opening 3' and a second lateral opening 4' are defined, the cavity for receiving the hands V being bounded by a first surface 5' and a second surface 6 provided with air injection holes 7' for drying the hands.

Specifically, according to the invention, and as it can be seen in FIGS. 13, 14, 15, 16, 17 and 18, the hand dryer is characterized in that the air injection holes 8' closest to the lateral openings 3', 4' of the first surface 5' or of the second surface 6' are arranged closer to the lateral openings 3', 4' than the air injection holes 9' closest to the lateral openings 4', 3' of the second surface 5' or of the first surface 6' respectively, such that said holes 8 arranged closer to the lateral openings 3', 4' of the first 5' and/or of the second surface 6' do not have air injection holes arranged in front of them, thus allowing that the air injected by said holes arranged closer to the lateral openings 3', 4' to form air curtains which minimize or prevent the projection of drops of water towards the outside by said lateral openings 3', 4'.

Preferably, these holes 8' are a plurality of holes. However, a solution may be obviously a to single elongated hole which stretches vertically enough to constitute an air curtain.

As it can be seen in the embodiment illustrated in FIGS. 12, 14, 16 and 18 the air injection holes 9' closest to the lateral openings 3', 4' that do not have injection holes in front of them are arranged in the same surface, that is in the first surface 5' or in the second surface 6'.

Figure 19:
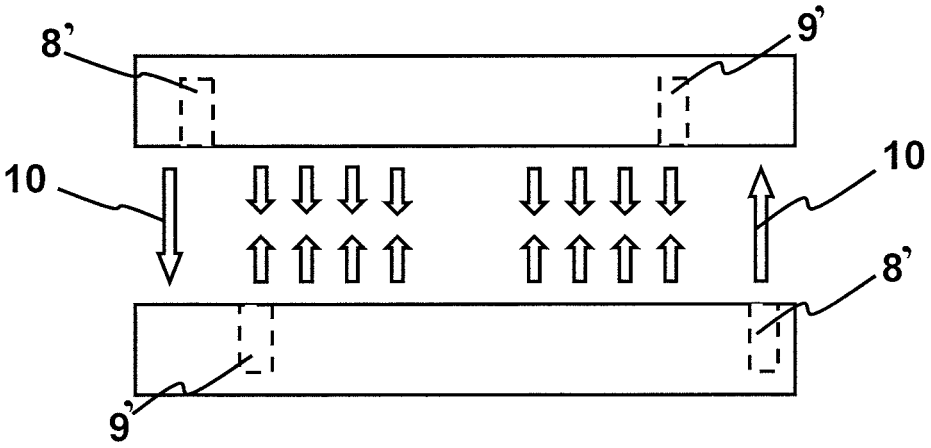
FIG. 19 diagrammatically shows the effect of the air curtain of a hand dryer according to the present invention wherein the side curtains have different blowing senses.

According to another embodiment, the end holes can be placed to achieve the effect shown in FIG. 19.

In the embodiments shown, the air injection holes 9' closest to the lateral openings 3', 4' that do not have injection holes in front of are arranged in vertical rows. Even then, they could be arranged in zigzag, or any other vertical arrangement that would create an air curtain.

Figure 15:
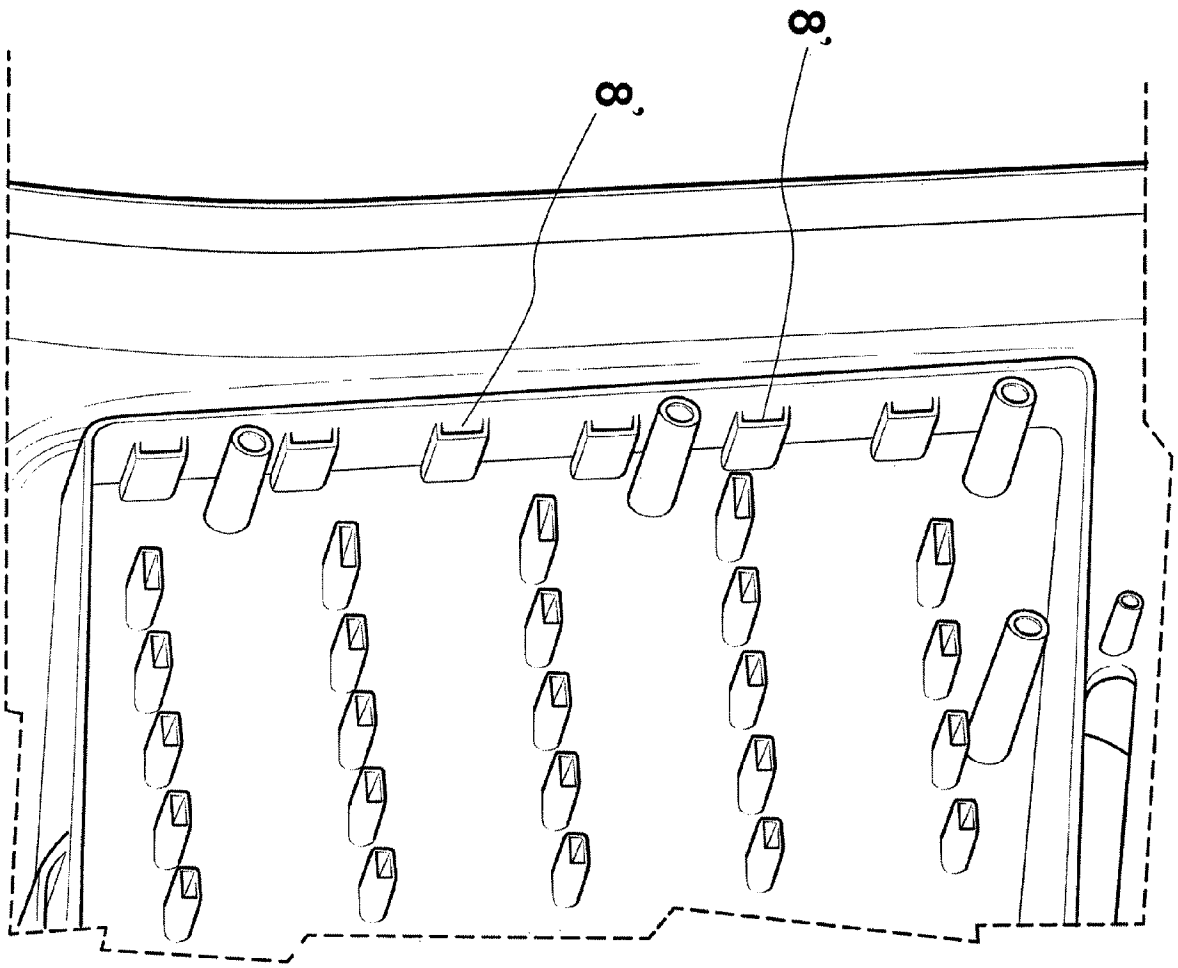
FIG. 15 is an enlarged view showing the arrangement of the oblong holes for forming the air curtain, which are vertically arranged in a row.
Figure 16:
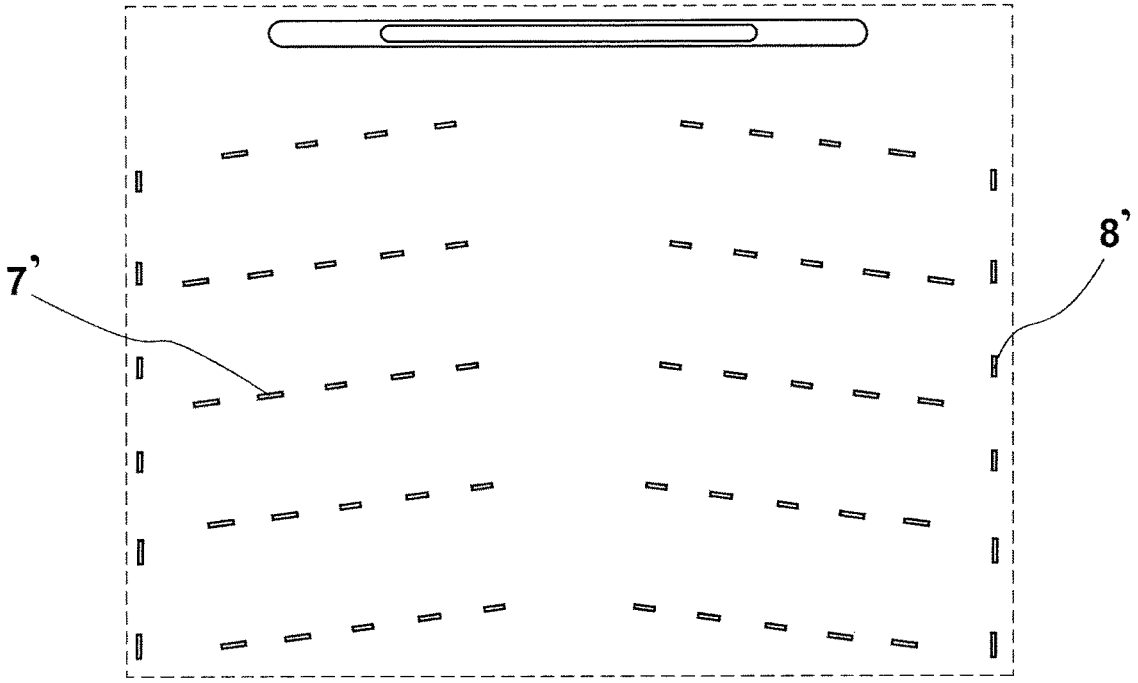
FIG. 16 is a front view of the surface comprising the holes for forming a lateral air curtain. Normal drying holes are also visible.
Figure 17:
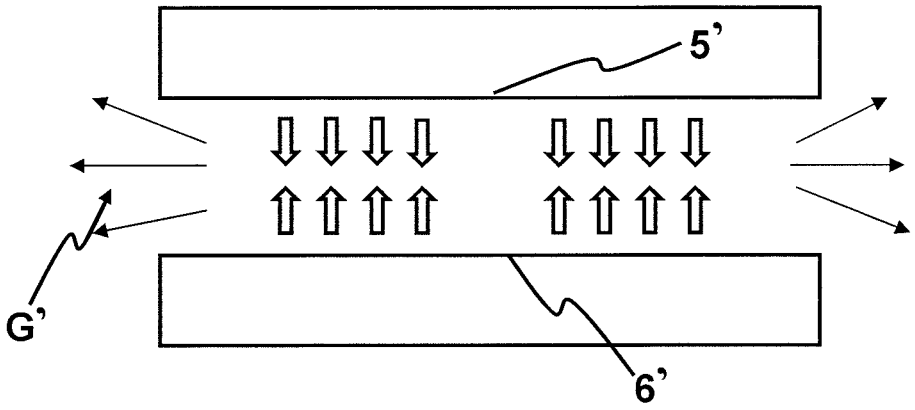
FIG. 17 diagrammatically shows the effect of projection of drops of a hand dryer of the prior art.

As shown for example in FIGS. 15 and 16 the air injection holes 9' closest to the lateral openings 3', 4' that do not have injection holes in front of them have an oblong section with the longest axis oriented in the vertical direction.

According to another aspect of the present invention, the injection holes are distributed in at least three groups:

- a first group of holes which air passage sections are inside a first range of air passage sections;
- a second group of holes which air passage sections are inside a second range of air passage sections;
- a third group of holes which air passage sections are inside a third range of air passage sections;

The three ranges being different.

According to a specially preferred embodiment,

The holes of the first group have a section of 8.5 $mm^2$;

The holes of the second group have a section of 10 $mm^2$;

The holes of the third group have a section of 11.5 $mm^2$;

The first surface 5 is the closest to the user and the second surface 6' is the closest to the fixing surface of the hand dryer and:

- The first surface 5' has between 14 holes of the first group, 16 holes of the second group and 18 holes of the third group;
- the second surface 6' has between 16 holes of the first group, between 16 holes of the second group and between 16 holes of the third group;

As it can be seen for example in FIG. 16 the holes of the first, second and third are oblong and are arranged with the longest axis oriented along a substantially horizontal direction.

Figure 18:
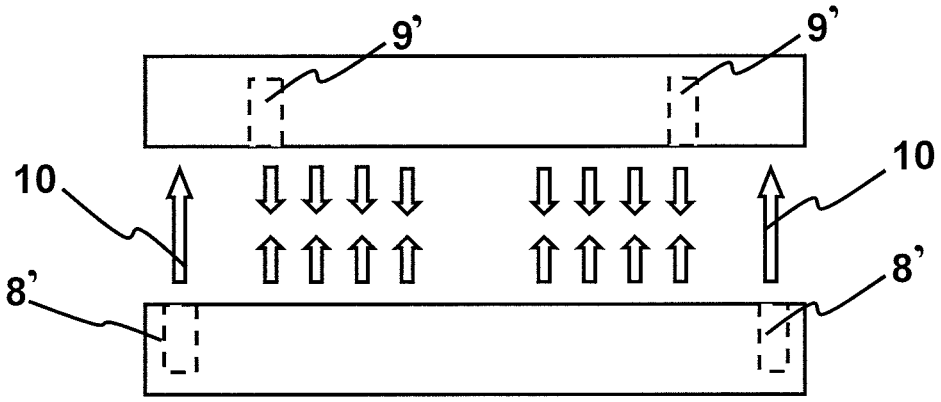
FIG. 18 schematically shows the effect of the air curtain of a hand dryer according to the present invention.

Also a fourth group of oblong holes 8' is provided, vertically arranged and with a section of 10.5 $mm^2$, said holes being arranged at the sides of the first surface or of the second surface, such that they form air curtains 10', as it can be seen in FIGS. 18 and 19.

Figure 13:
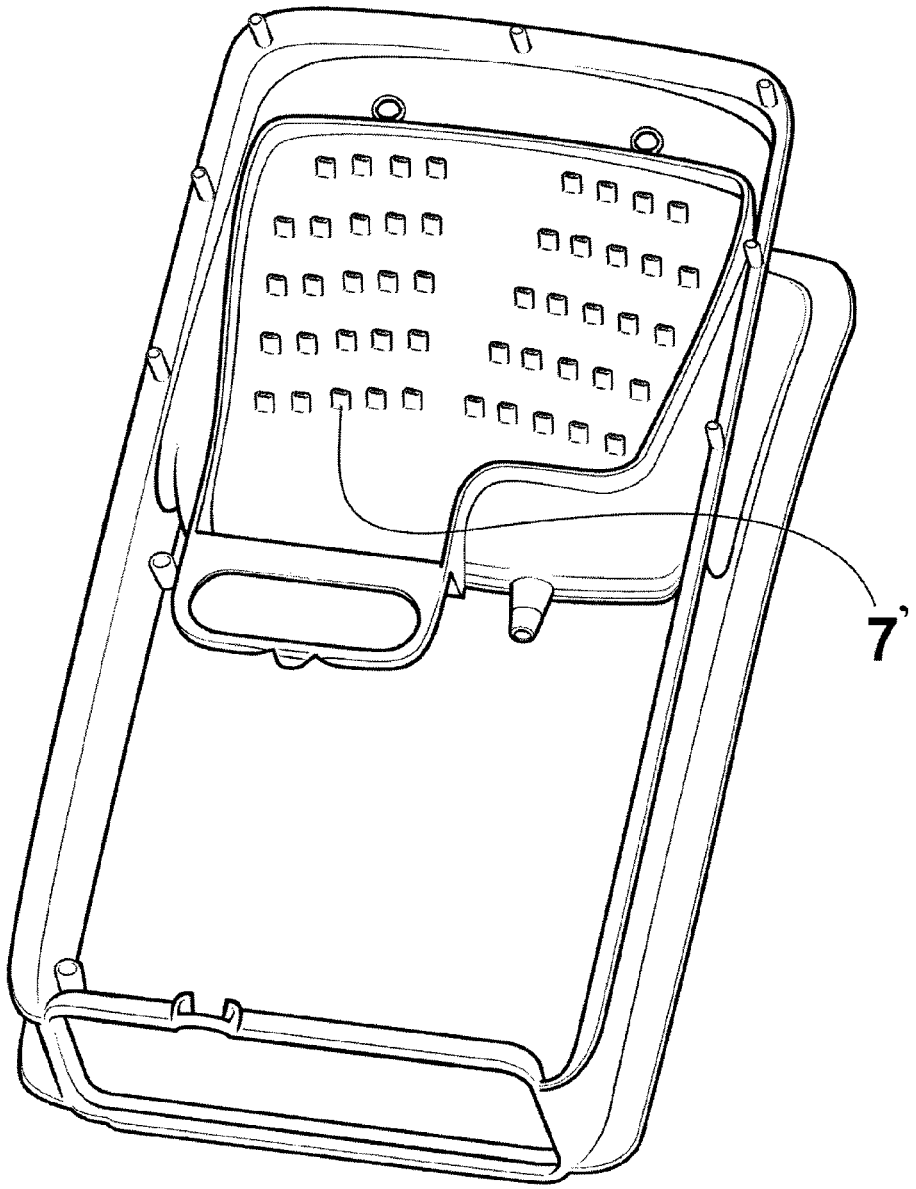
FIG. 13 shows the part comprising the surfaces provided with holes of the side not having the lateral holes for the production of air curtains.
Figure 14:
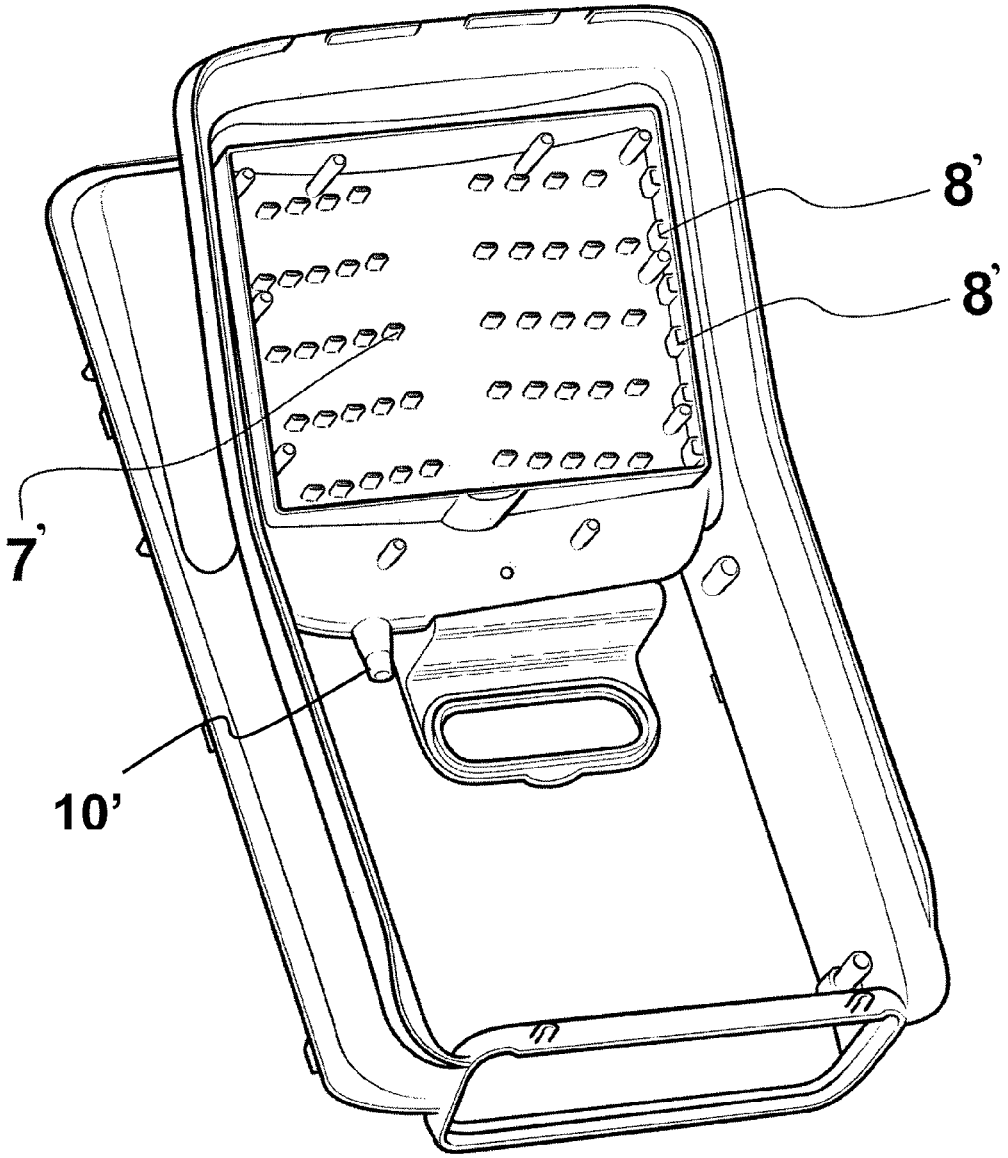
FIG. 14 shows the part comprising the surfaces provided with holes of the side having the lateral holes for the production of air curtains.

As it can be seen in FIGS. 13, 14 and 15 the holes of the first, second and third each have an associated channel which extends as a protrusion in an air distribution chamber arranged behind each one of the first 5' and second 6' surfaces.

Figure 20:
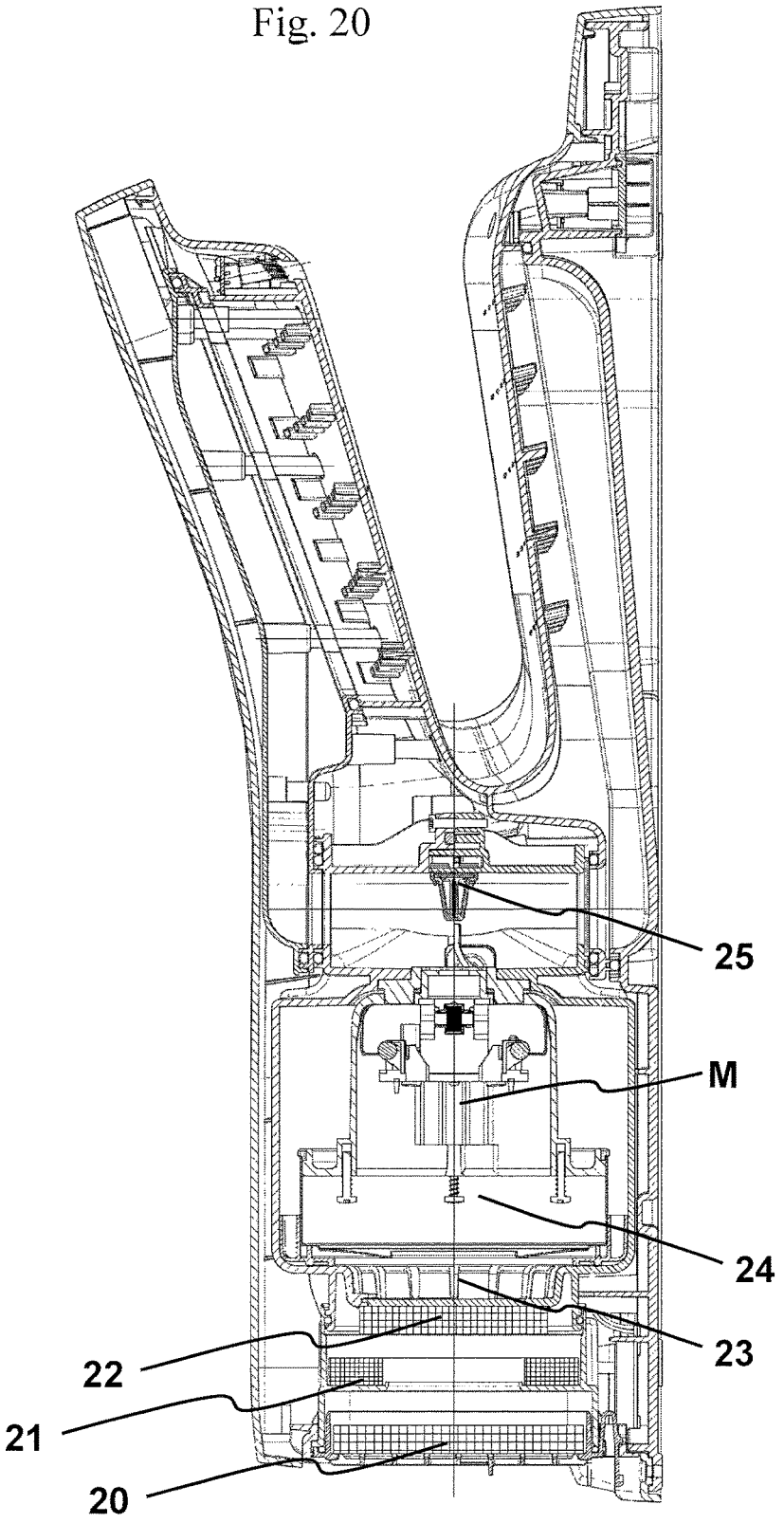
FIG. 20 shows the section of the silencing elements arranged in the air intake path.

As it can be seen in FIG. 20, the hand dryer comprises a driving motor-fan group M and air silencing elements arranged upstream of said driving motor-fan group M, said air silencing elements comprising, arranged in the sense of the air circulation:

An air inlet grille 20;

An air passage surrounded by a crown of foam 21;

A foam block 22 interposed in the air path;

An air inlet grille to the motor 23;

The internal circulation of air circulation comprises an ion generation unit 25, preferably of ozone, to provide the air with sterilizing characteristics.

As it can be seen in FIG. 14, the reception cavity V of the hands can comprise a hole of evacuation of water 10' at the bottom.

As shown in FIG. 12, the first surface 5' is tilted 15° and a second surface 6' tilted between 8° and 10° with respect to the vertical direction.

Although reference has been made to specific embodiments of the invention, it will be apparent to one skilled in the art that the hand dryer described is susceptible of numerous variations and modifications, and that all the details mentioned can be replaced with other technically equivalent, without departing from the scope of protection defined by the appended claims.

The invention claimed is:

1. Hand dryer (1) comprising:
- a housing (2);
- a volume (3) for receiving hands (4);
- a circuit for pumping air;
- a drive motor (5) which drives a fan (T) arranged in the circuit provided with a rotor (6) and a stator (7);
- a hand presence sensor (8) in a volume (3);
- operation control means (9);
- wherein the operation control means (9) are configured for operating at least in two operating regimes:
- a normal operating regime wherein the drive motor (5) pumps air for drying hands and which is activated by the hand presence sensor detection (8);
- a motor heating operating regime (5) wherein the stator (7) and/or the rotor (6) of the motor (5) are fed for increasing temperature and maintain a predetermined temperature for accumulating heat activated by no detection of the hand presence sensor (8);
- such that at a start of a normal operating regime, the drive motor (5) is provided with stored heat for ensuring that the air exits heated.

2. Hand dryer according to claim 1, which does not comprise a separate heating circuit apart from motor circuits.

3. Hand dryer according to claim 2, wherein the motor is an alternating current motor.

4. Hand dryer according to claim 3, comprising, arranged in series:
- a first portion of stator winding (L1);
- a second portion of stator winding (L2);
- rotor-brushes assembly;
- a third portion of stator winding (L3);
- a fourth portion of stator winding (L4).

5. Hand dryer according to claim 4, comprising:
- a first relay (RL1) between supply voltage (F) and first portion of stator winding (L1);
- a second relay (RL2) between neutral point (N) and fourth portion of stator winding (L4);
- a third relay (RL3) for grounding of connecting point between second portion of stator winding (L2) and rotor-brushes assembly;
- a fourth relay (RL4) for the grounding of connecting point between third portion of stator winding (L3) and the rotor-brushes assembly;

the relays (RL1, RL2, RL3, RL4) being connected to the operation control means (9).

6. Hand dryer according to claim 4, comprising:

a first relay (RL1) between the supply voltage (F) and the first portion of stator winding (L1);

a second relay (RL2) between the neutral point (N) and the fourth portion of stator winding (L4);

a third relay (RL3) for short-circuiting terminals of the rotor-brushes assembly;

the relays (RL1, RL2, RL3) being connected to the operation control means (9).

7. Hand dryer according to claim 4, comprising:

a first relay (RL1) between the supply voltage (F) and the first portion of stator winding (L 1);

a second relay (RL2) between the neutral point (N) and the fourth portion of stator winding (L4);

a third relay (RL3) between the first portion of stator winding (L 1) and the second portion of stator winding (L2);

a fourth relay (RL4) between the third portion of stator winding (L3) and the fourth portion of stator winding (L4);

the third relay (RL3) being arranged for connecting terminal of the first winding either with the second portion of stator winding (L2) or with the neutral point (N);

the fourth relay (RL4) being arranged for connecting the terminal of the fourth portion of stator winding either with the third portion of stator winding (L3) or with the supply voltage; the relays (RL1, RL2) being connected to the operation control means (9).

8. Hand dryer according to claim 4, comprising:

a first relay (RL1) between the supply voltage (F) and the first portion of stator winding (L1);

a second relay (RL2) between the neutral point (N) and the fourth portion of stator winding (L4);

the relays (RL1, RL2) being connected to the operation control means (9).

9. Hand dryer according to claim 3, comprising, arranged in series:

a first portion of stator winding (L1);

a second portion of stator winding (L2);

the rotor-brushes assembly;

a third portion of stator winding (L3);

a fourth portion of stator winding (L4).

10. Hand dryer according to claim 9, comprising a relay (RL1) for short-circuiting the terminals of the rotor-brushes assembly connected to the operation control means (9).

11. Hand dryer according to claim 9, comprising:

a first relay (RL1) between the first portion of stator winding (L1) and the second portion of stator winding (L2);

a second relay (RL2) between the third portion of stator winding (L3) and the fourth portion of stator winding (L4);

the relays being connected between them such that the first and fourth portions can be connected between them; the relays (RL1, RL2) being connected to the operation control means (9).

12. Hand dryer according to claim 9, comprising:

a first relay (RL 1) between the first portion of stator winding (L1) and the second portion of stator winding (L2);

a second relay (RL2) between the third portion of stator winding (L3) and the fourth portion of stator winding (L4);

the first relay (RL1) being arranged for connecting the terminal of the first winding or either with the second portion of stator winding (L2) or either with the neutral point (N);

the second relay (RL2) being arranged for connecting the terminal of the fourth portion of stator winding either with the third portion of stator winding (L3) or with the supply voltage; the relays (RL1, RL2) being connected to the operation control means (9).

13. Hand dryer according to claim 5, comprising a voltage regulating unit (REG) arranged in series between the fourth portion of stator and the neutral point.

14. Hand dryer according to claim 1, wherein the motor is a brushless motor.

15. Hand dryer according to claim 6, comprising a voltage regulating unit (REG) arranged in series between the fourth portion of stator and the neutral point.

16. Hand dryer according to claim 7, comprising a voltage regulating unit (REG) arranged in series between the fourth portion of stator and the neutral point.

17. Hand dryer according to claim 10, comprising a voltage regulating unit (REG) arranged in series between the fourth portion of stator and the neutral point.

18. Hand dryer according to claim 11, comprising a voltage regulating unit (REG) arranged in series between the fourth portion of stator and the neutral point.

19. Hand dryer according to claim 12, comprising a voltage regulating unit (REG) arranged in series between the fourth portion of stator and the neutral point.

20. Hand dryer according to claim 8, comprising a voltage regulating unit (REG) arranged in series between the fourth portion of stator and the neutral point.

* * * * *